US008006537B2

(12) United States Patent
Liu

(10) Patent No.: US 8,006,537 B2
(45) Date of Patent: Aug. 30, 2011

(54) COAXIAL TERMINAL CONNECTING TOOL

(75) Inventor: Jen-Kai Liu, Taipei (TW)

(73) Assignee: Jetool Corp., New Taipei (TW)

( * ) Notice: Subject to any disclaimer, the term of this patent is extended or adjusted under 35 U.S.C. 154(b) by 340 days.

(21) Appl. No.: 12/356,538

(22) Filed: Jan. 21, 2009

(65) Prior Publication Data

US 2010/0180661 A1 Jul. 22, 2010

(51) Int. Cl.
*B21F 15/00* (2006.01)
*B25B 7/12* (2006.01)
*B21J 9/18* (2006.01)

(52) U.S. Cl. ..... 72/409.14; 72/409.08; 72/450

(58) Field of Classification Search ..... 72/409.1, 72/409.4, 409.06, 409.08, 409.14, 450; 29/270, 29/729, 758, 764
See application file for complete search history.

(56) References Cited

U.S. PATENT DOCUMENTS

| | | | | |
|---|---|---|---|---|
| 5,647,119 | A * | 7/1997 | Bourbeau et al. | 29/751 |
| 5,941,120 | A * | 8/1999 | Jee | 72/409.14 |
| 6,293,004 | B1 * | 9/2001 | Holliday | 29/751 |
| 6,594,888 | B2 * | 7/2003 | Chang | 29/751 |
| 6,708,396 | B2 * | 3/2004 | Holliday | 29/751 |
| 6,732,393 | B1 * | 5/2004 | Liao | 7/158 |
| 7,028,393 | B2 * | 4/2006 | Wei | 29/761 |
| 7,096,573 | B2 * | 8/2006 | Holliday | 29/751 |
| 7,120,997 | B2 * | 10/2006 | Islam et al. | 29/751 |
| 7,562,442 | B2 * | 7/2009 | Montena | 29/751 |
| 7,594,315 | B2 * | 9/2009 | Montena | 29/751 |
| 7,596,860 | B2 * | 10/2009 | Sutter et al. | 29/751 |
| 7,627,944 | B2 * | 12/2009 | Holliday | 29/751 |
| 7,703,196 | B2 * | 4/2010 | Chawgo | 29/751 |
| 7,761,979 | B2 * | 7/2010 | Wang | 29/758 |
| 7,797,827 | B2 * | 9/2010 | Sutter | 29/861 |
| 2010/0180661 | A1 * | 7/2010 | Liu | 72/409.08 |

* cited by examiner

*Primary Examiner* — Dana Ross
*Assistant Examiner* — Lawrence Averick

(57) ABSTRACT

A coaxial terminal connecting tool includes a second handle portion, a first handle portion, and a transmitting portion. The second handle portion has a receiving slot including a guiding assembly and a terminal receiver. The terminal receiver fixing the terminal element is formed at an end of the receiving slot. The first handle portion is pivoted to an end of the second handle portion. An end of the transmitting portion is pivoted to a first predetermined position formed on the guiding assembly and another end thereof is pivoted to a second predetermined position formed on the first handle portion. A length of the transmitting portion is adjustable. An end of the adjusting unit is arranged to a first predetermined position of the guiding assembly, while another end thereof is pivoted to the transmitting portion. The adjusting unit consists of a first sliding portion, adjusting portion, and a second sliding portion.

8 Claims, 9 Drawing Sheets

COAXIAL TERMINAL CONNECTING TOOL

FIELD OF THE PRESENT INVENTION

The present invention relates to connecting tool, and particular to a more power-saving coaxial terminal connecting tool for various types of coaxial terminals.

DESCRIPTION OF THE PRIOR ART

A prior coaxial terminal connecting tool will need different pressing components while connecting different types of coaxial terminal (such as F type coaxial terminal, BNC coaxial terminal) or coaxial terminal in same type but different specification (such as different lengths). There are coaxial terminal connecting tools capable of replacing various pressing components for different types or specifications of coaxial terminal, but higher cost and storage problem disturb user for preparing various pressing components.

The coaxial terminal tool includes a handle, base, and transmitting unit. The handle is pivoted to an end of the base so that a linking mechanism between the handle, base, and the transmitting unit is formed. In a prior art, in order to apply different types and lengths of coaxial terminal to one tool, an adjusting unit and connecting portion are arranged to the transmitting unit so that a length of the tool can be adjustable. With reference to FIG. 1, a prior coaxial terminal connecting tool 20 is illustrated. A second connecting portion 13 of a transmitting unit 10 pivoted to a handle 50 can be shifted upwards by an adjusting unit 12 of the handle 50. A distance between a pressing component 31 linking to a first connecting portion 14 of the transmitting unit 10 and a terminal fixing unit 60 is thus changed so that the pressing component 31 is capable of connecting different types and lengths of coaxial terminal.

However, the second connecting portion 13 moved by the adjusting unit 12 will also lengthen a distance of the handle 50. Thus, more strength will be needed to operate the tool and more inconveniences are caused to the user and the process.

Therefore, to resolve the problems of the prior art, a more power-saving coaxial terminal connecting tool for various types of coaxial terminal is needed.

SUMMARY OF THE PRESENT INVENTION

Accordingly, the primary object of the present invention is to provide a coaxial terminal connecting tool with a transmitting shaft which a length thereof is adjustable.

A secondary object of the present invention is to provide a coaxial terminal connecting tool which a base thereof is capable of receiving a pressing component for coaxial terminals.

To achieve above object, the present invention provides a coaxial terminal connecting tool comprising: a second handle portion 2 having a receiving slot; the receiving slot having a guiding assembly and a terminal receiver; a first handle portion having one end which is pivoted to an end of the second handle portion; a transmitting portion pivoted to a first predetermined position formed on the guiding assembly with an end and another end thereof being pivoted to a second predetermined position formed on the first handle portion; an adjusting unit having one end being arranged to a first predetermined position of the guiding assembly, while another end of the adjusting unit being pivoted to the transmitting portion; the adjusting unit including a first sliding portion pivoted to the transmitting portion and received in the receiving slot;

an adjusting portion having a thread at one end thereof and a pressing portion being formed to another end thereof; an end of the first sliding portion having a thread hole corresponding to the thread;

a second sliding portion received in the receiving slot, and a through hole corresponding to the thread of the adjusting portion is formed to an end of the second sliding portion;

wherein the adjusting portion is connected to the second sliding portion; by changing a distance through the thread of the adjusting portion and the thread hole of the second sliding portion, the second sliding portion will be moved and the adjusting portion will be pushed by the first sliding portion so that various types of coaxial terminal is adaptable to the power-saving coaxial terminal connecting tool.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
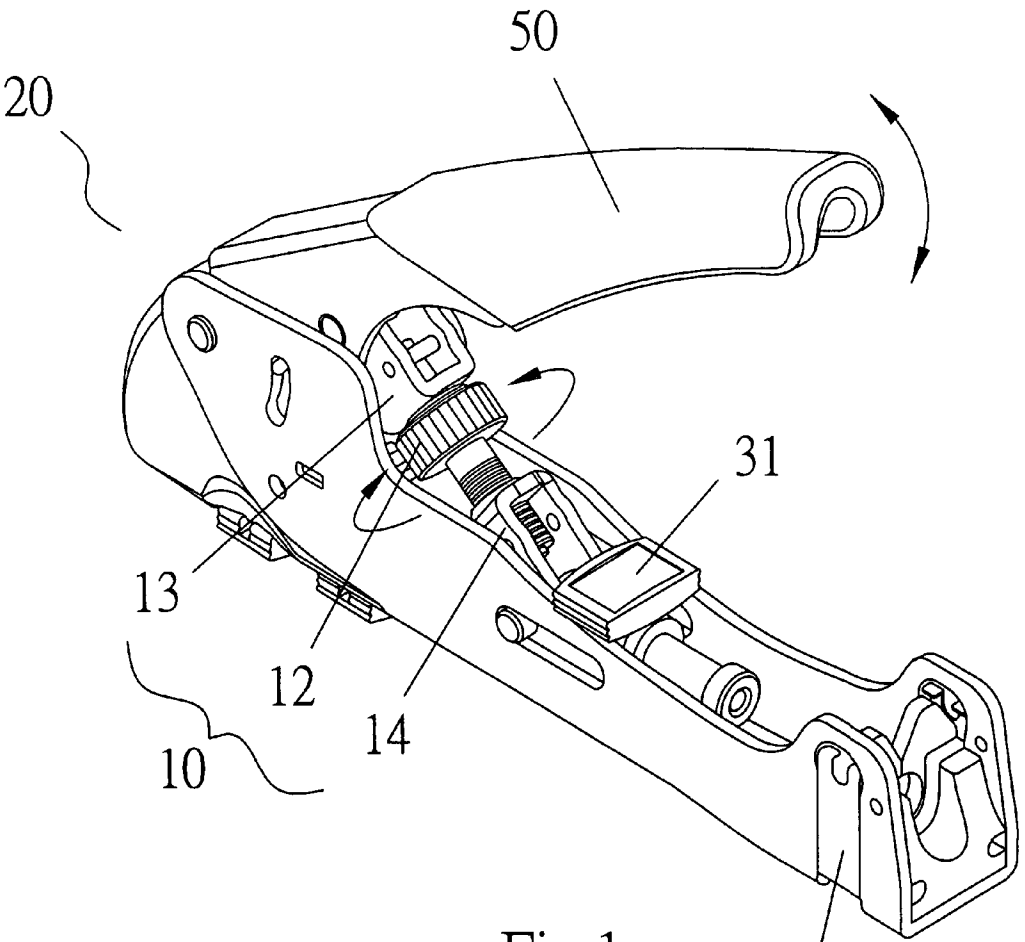
Fig.1 (Prior Art)
FIG. 1 shows a prior coaxial terminal connecting tool.
Figure 2:
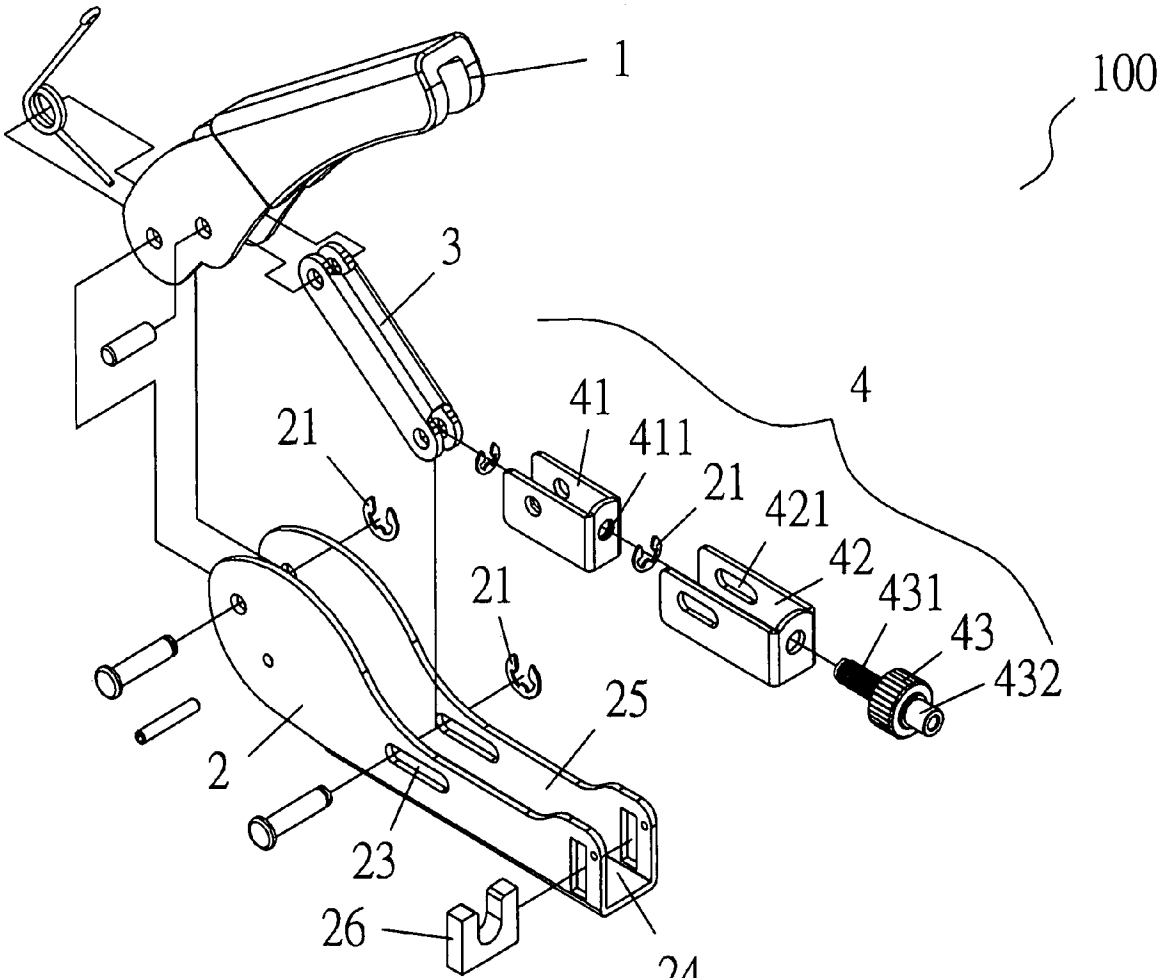
FIG. 2 is a structural schematic view of the coaxial terminal connecting tool of the present invention.

With reference to FIG. 2, a structural drawing of a coaxial terminal connecting tool of the present invention is shown. The coaxial terminal connecting tool 100 according to the present invention includes a first handle portion 1, second handle portion 2, transmitting portion 3 and adjusting unit 4. By the above structure, a chain mechanism linking the first handle portion 1, second handle portion 2, transmitting portion 3 and the adjusting unit 4 is formed. Wherein, the second handle portion 2 has a receiving slot 25 which includes a guiding assembly 24 and a terminal receiver 26. The terminal receiver 26 fixing the terminal element is formed at an end of the receiving slot 25. The first handle portion 1 is pivoted to an end of the second handle portion 2. An end of the transmitting portion 3 pivots to a first predetermined position formed on the guiding assembly 24 and another end thereof pivots to a second predetermined position formed on the first handle portion 1. The length of the adjusting unit 4 is adjustable. An end of the adjusting unit 4 is arranged to the first predetermined position of the guiding assembly 24, while another end thereof is pivoted to an end of the transmitting portion 3. The adjusting unit 4 consists of a first sliding portion 41, adjusting portion 43, and a second sliding portion 42. The first sliding portion 41 and the second sliding portion 42 are received in the receiving slot 25. An end of the first sliding portion 41 is pivoted to the transmitting portion 3, and a threaded hole 411 corresponding to an thread 431 of the adjusting portion 43 is formed to another end of the first sliding portion 41. An end of the second sliding portion 42 is pivoted to the first sliding portion 41, and a through hole corresponding to the thread 431 of the adjusting portion 43 is formed to another end of the second sliding portion 42. The tread 431 is formed to an end of the adjusting portion 43, and a pressing portion 432 is formed to another end thereof. The tread 431 of the adjusting portion 43 is passed through the hole of the second sliding portion 42 and screwed into the thread hole 411 of the first sliding portion 41 so that the second sliding portion 42 is moved along the first sliding portion 41. The transmitting portion 3 is pushed by the first sliding portion 41. The length of the adjusting unit 4 is adjustable by screwing the thread 431 of the adjusting portion 43 in the thread hole 411 of the sliding portion 41. A limiting slot 421 limiting the adjusting distance of the adjusting unit 4 is formed to the second sliding portion 42 so as to prevent the adjusting portion 43 escaping from the second sliding portion 42. A limiting slot 23 preventing an over adjusting distance of the adjusting unit 4 is formed to the receiving slot 25 of the second handle portion 2. Through the above structure, different terminal objects are adaptable for the power-saving coaxial terminal connecting tool of the present invention.

Figure 3:
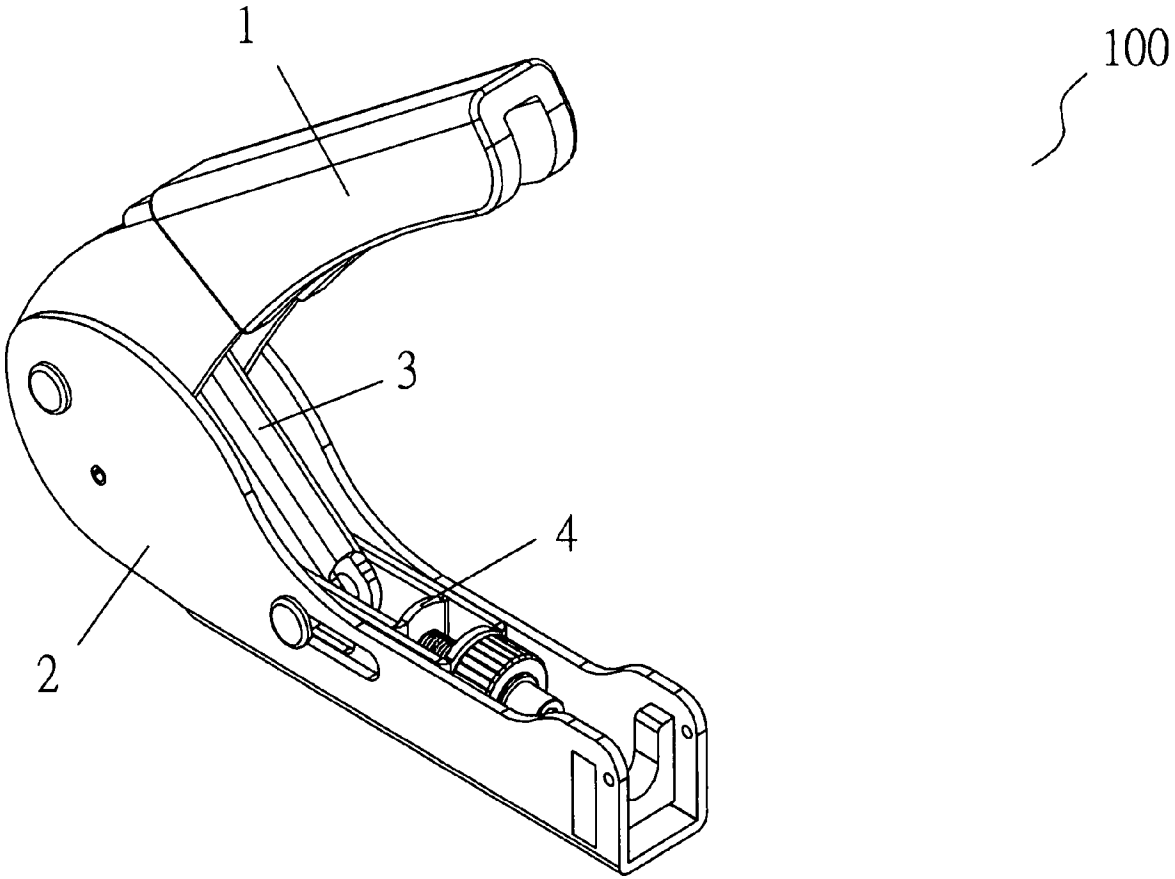
FIG. 3 is a schematic view showing an appearance of the coaxial terminal connecting tool of the present invention.

A schematic drawing showing the appearance of the coaxial terminal connecting tool of the present invention is illustrated in FIG. 3. With reference to FIG. 3, a coaxial terminal connecting tool 100 is assembled by the first handle portion 1, second handle portion 2, transmitting portion 3 and adjusting unit 4.

Figure 4:
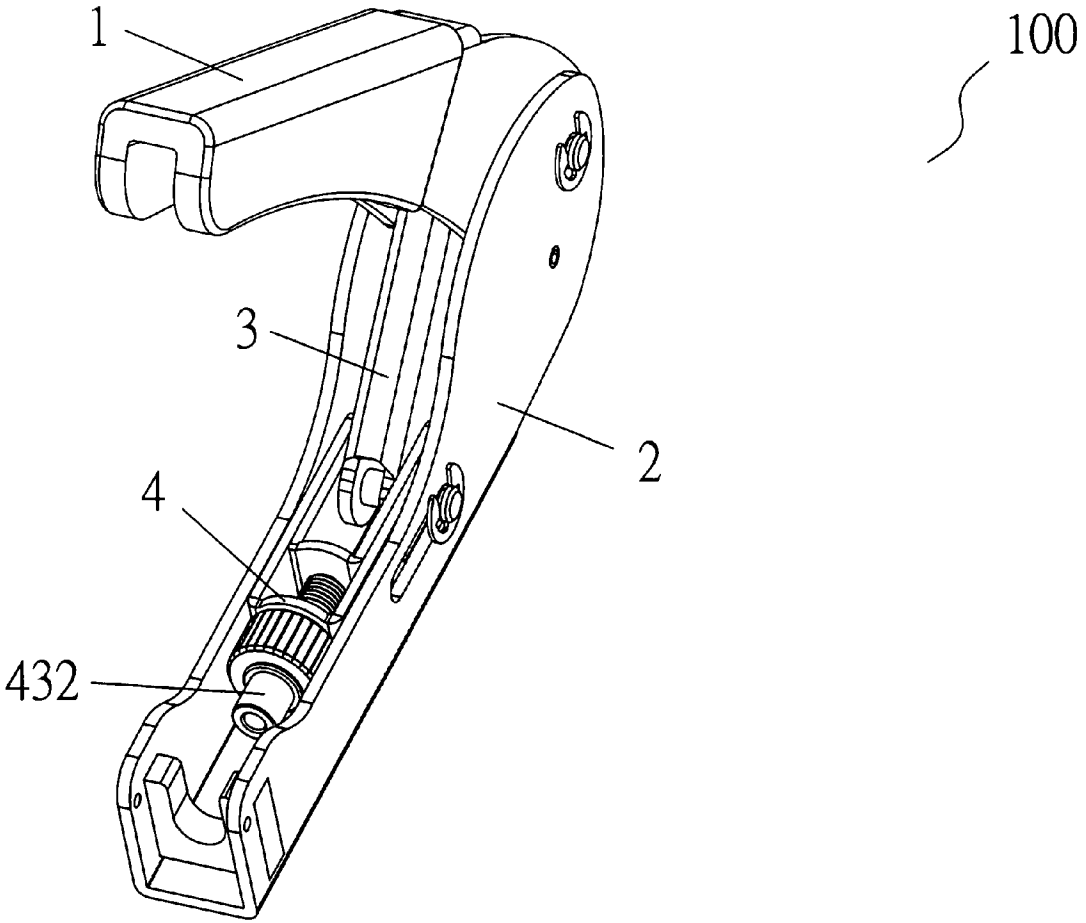
FIG. 4 is a schematic view showing the operation of the coaxial terminal connecting tool of the present invention.
Figure 5:
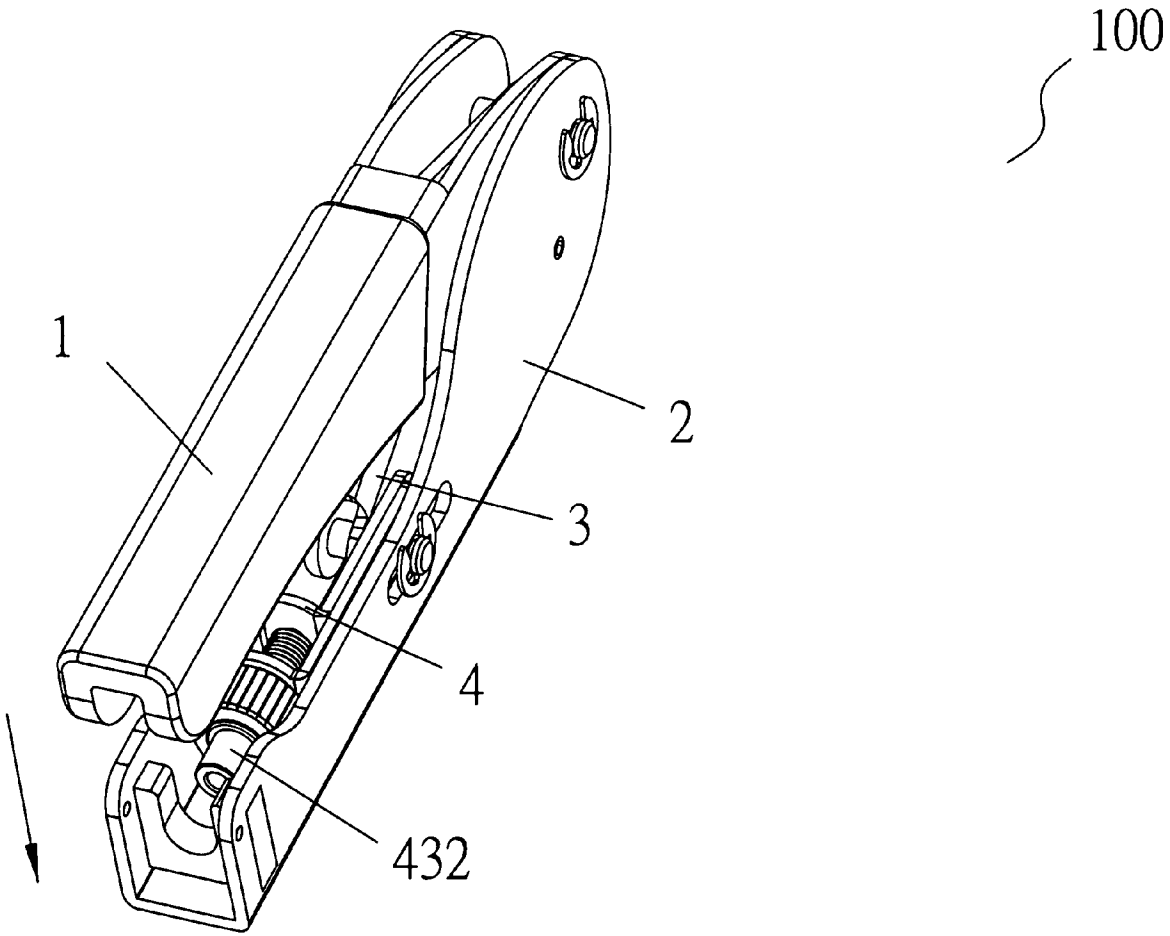
FIG. 5 is another schematic view showing the operation of the coaxial terminal connecting tool of the present invention.
Figure 6:
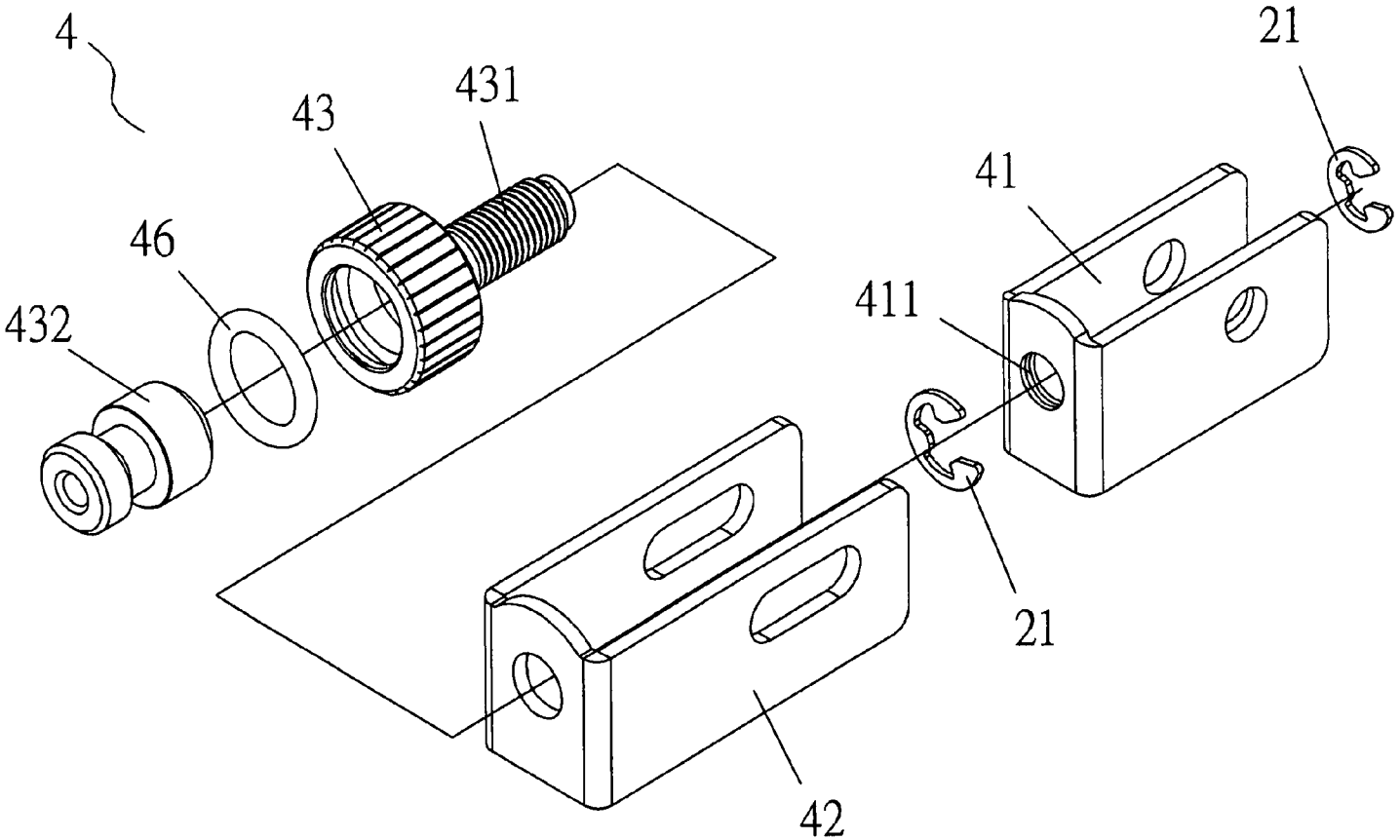
FIG. 6 is a schematic view showing an assembly of an adjusting unit of the coaxial terminal connecting tool of the present invention.
Figure 7:
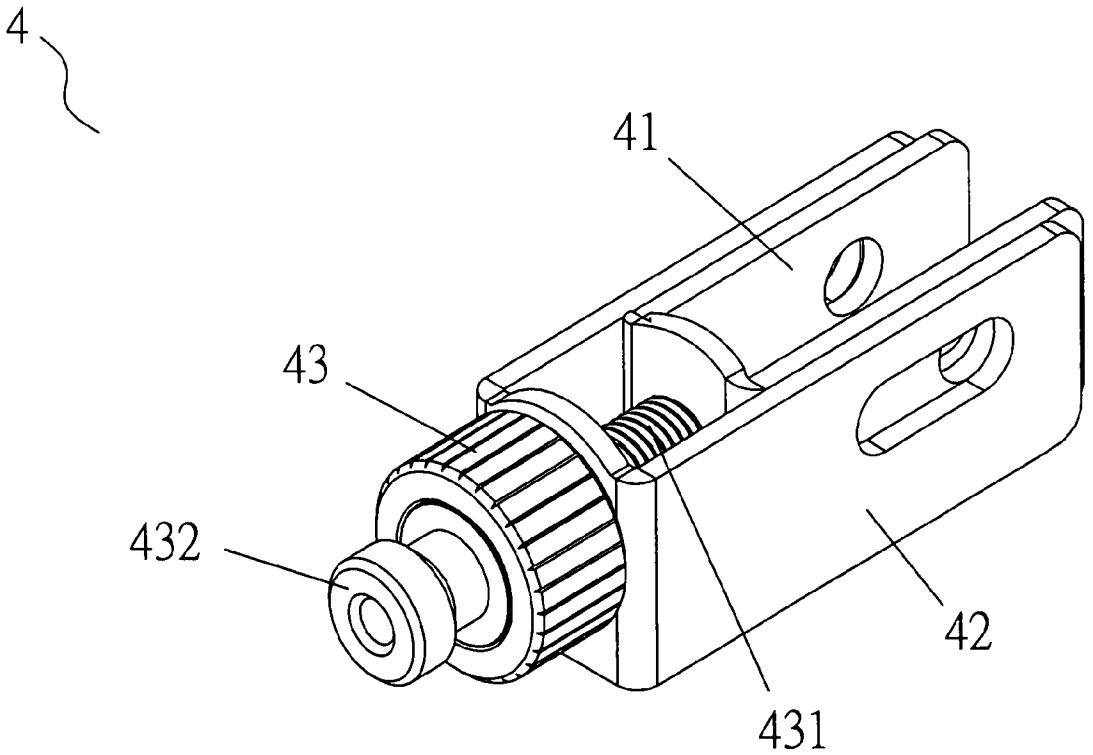
FIG. 7 is another schematic view showing the assembly of the adjusting unit of the coaxial terminal connecting tool of the present invention.
Figure 8:
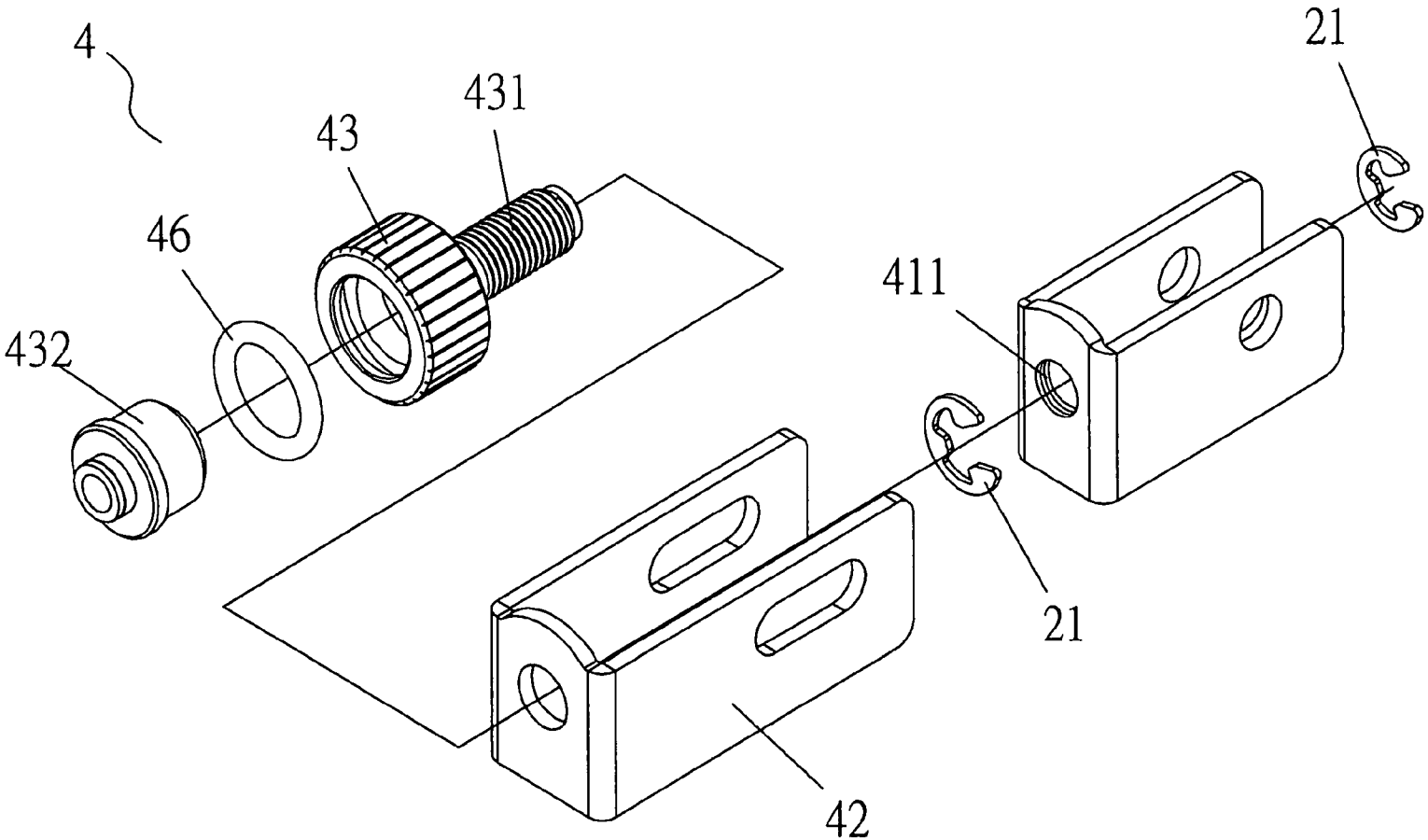
FIG. 8 is one another schematic view showing the assembly of the adjusting unit of the coaxial terminal connecting tool of the present invention.
Figure 9:
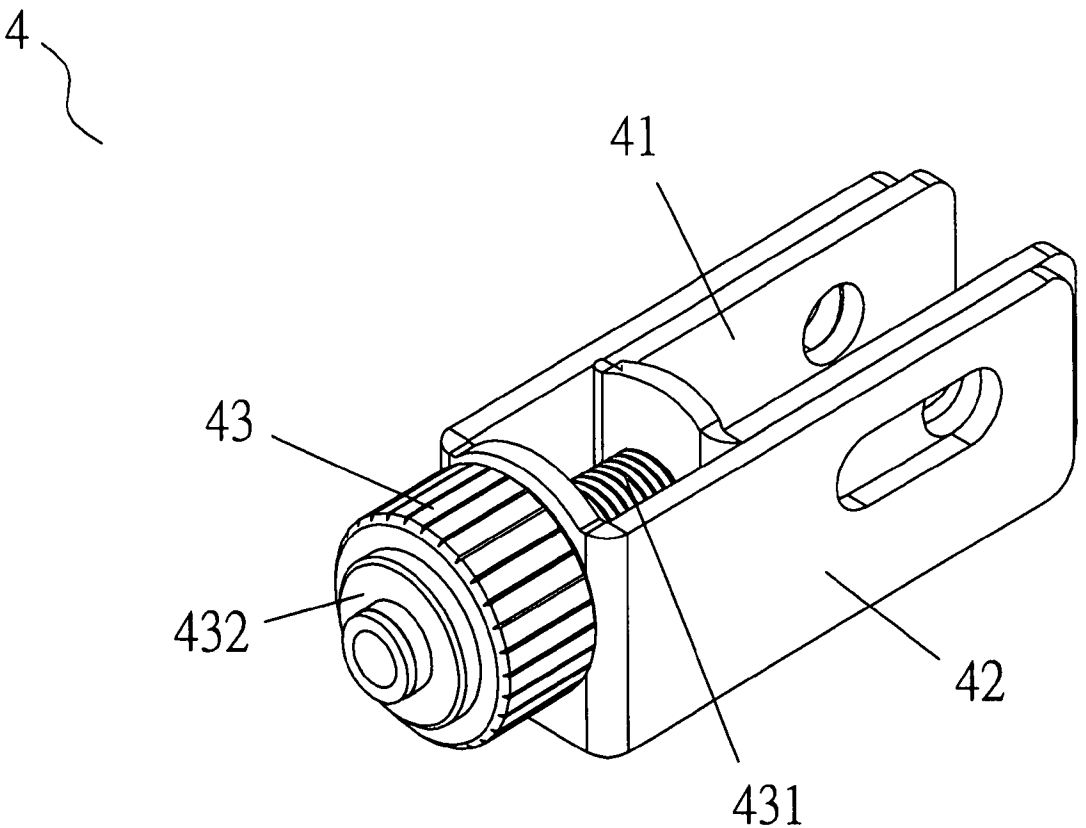
FIG. 9 is one another schematic view showing the assembly of the adjusting unit of the coaxial terminal connecting tool of the present invention.

FIGS. 4 and 5 show the operations of the coaxial terminal connecting tool of the present invention. Referring to the FIGS. 4 and 5, by pressing the first handle portion 1 towards the second handle portion 2, the transmitting portion 3 will be moved as well as the adjusting unit 4 so that the pressing portion 432 will be moved forward and a coaxial terminal will be pressed and formed.

Schematic views showing the assembly of the adjusting unit of the coaxial terminal connecting tool of the present invention are illustrated in FIGS. 6, 7, 8, and 9. The adjusting unit 4 consists of the first sliding portion 41, adjusting portion 43, and the second sliding portion 42. The first sliding portion 41 and the second sliding portion 42 are received in the receiving slot 25. An end of the first sliding portion 41 is pivoted to the transmitting portion 3, and the threaded hole 411 corresponding to the thread 431 of the adjusting portion 43 is formed to another end of the first sliding portion 41. One end of the second sliding portion 42 is pivoted to the first sliding portion 41, and the through hole corresponding to the thread 431 of the adjusting portion 43 is formed to another end of the second sliding portion 42. The tread 431 is formed to one end of the adjusting portion 43, and the pressing portion 432 is formed to another end thereof. A fixing unit 21 (C ring) is arranged between the second sliding portion 42 and the adjusting portion 43 to prevent the adjusting portion 43 escaping while adjusting. Another fixing unit 21 is arranged between the first sliding portion 41 and the second sliding portion 42 to prevent a disconnection while adjusting the adjusting portion 43. The pressing portion 432 is fixed by an elastic element 46 (O-ring) and the pressing portion 432 is replaceable for different types of coaxial terminal.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A coaxial terminal connecting tool comprising:

a second handle portion 2 having a receiving slot; the receiving slot having a guiding assembly and a terminal receiver;

a first handle portion having one end which is pivoted to an end of the second handle portion;

a transmitting portion pivoted to a first predetermined position formed on the guiding assembly with an end and another end thereof being pivoted to a second predetermined position formed on the first handle portion;

an adjusting unit having one end being arranged to a first predetermined position of the guiding assembly, while another end of the adjusting unit being pivoted to the transmitting portion; the adjusting unit including a first sliding portion pivoted to the transmitting portion and received in the receiving slot;

an adjusting portion having a thread at one end thereof and a pressing portion being formed to another end thereof; an end of the first sliding portion having a thread hole corresponding to the thread;

a second sliding portion received in the receiving slot, and a through hole corresponding to the thread of the adjusting portion is formed to an end of the second sliding portion;

wherein the adjusting portion is connected to the second sliding portion; by changing a distance through the thread of the adjusting portion and the thread hole of the second sliding portion, the second sliding portion will be moved and the adjusting portion will be pushed by the first sliding portion so that various types of coaxial terminal is adaptable to the power-saving coaxial terminal connecting tool.

2. The coaxial terminal connecting tool as claimed in claim 1, wherein the pressing portion is capable of connecting different types of coaxial terminal.

3. The coaxial terminal connecting tool as claimed in claim 1, wherein a limiting slot is formed to the second sliding portion to limit the maximum and minimum traveling of the second sliding portion so as to prevent the thread of the adjusting portion escaping or contacting the transmitting portion.

4. The coaxial terminal connecting tool as claimed in claim 1, wherein a fixing unit is arranged to the second handle portion to prevent a disconnection while operating the coaxial terminal connecting tool.

5. The coaxial terminal connecting tool as claimed in claim 1, wherein a fixing unit is arranged between the first sliding portion and the second sliding portion to prevent a disconnection while adjusting the adjusting portion.

6. The coaxial terminal connecting tool as claimed in claim 1, wherein a fixing unit is arranged between the second sliding portion and the adjusting portion to prevent a disconnection while adjusting the adjusting portion.

7. The coaxial terminal connecting tool as claimed in claim 1, wherein the pressing portion is fixed by an elastic element and is replaceable for different types of coaxial terminal.

8. The coaxial terminal connecting tool as claimed in claim 1, wherein the terminal receiver fixing the terminal element is formed at an end of the receiving slot.

* * * * *